US011788824B2

(12) United States Patent
Battaglia et al.

(10) Patent No.: US 11,788,824 B2
(45) **Date of Patent: *Oct. 17, 2023**

(54) PISTON/ROCKET PROJECTILE WITH SEPARABLE CASING

(71) Applicant: Vincent Battaglia, Monroe, CT (US)

(72) Inventors: Vincent Battaglia, Easton, CT (US); Philip Battaglia, Monroe, CT (US); Gary Dabrowski, Monroe, CT (US)

(73) Assignee: VINCENT BATTAGLIA, Monroe, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/741,611

(22) Filed: May 11, 2022

(65) Prior Publication Data

US 2022/0268559 A1 Aug. 25, 2022

Related U.S. Application Data

(63) Continuation-in-part of application No. 17/331,160, filed on May 26, 2021, now Pat. No. 11,397,072.
(Continued)

(51) Int. Cl.
*F42B 5/10* (2006.01)
*F42B 5/184* (2006.01)
(Continued)

(52) U.S. Cl.
CPC ..... *F42B 5/18* (2013.01); *F42B 5/045* (2013.01); *F42B 5/184* (2013.01)

(58) Field of Classification Search
CPC .... F42B 5/10; F42B 5/08; F42B 5/067; F42B 5/073
See application file for complete search history.

(56) References Cited

U.S. PATENT DOCUMENTS 310,649 A * 1/1885 Chamberlain ..... F42B 5/10 102/375
1,446,711 A * 2/1923 Ludorf ..... F42B 5/10 102/380

(Continued)

*Primary Examiner* — Derrick R Morgan
(74) *Attorney, Agent, or Firm* — DeLio Peterson & Curcio LLC; Brian G. Schlosser

(57) ABSTRACT

A piston/rocket projectile for use within a launcher system having a barrel and method of firing such are presented herein. The projectile comprises a projectile body having a combustion chamber for propellant, a piston moveable to extend out a base of the projectile as a result of ignition of propellant in the combustion chamber, and vents for expulsion of combustion products from the ignition of propellant out of the projectile base after initial movement of the piston. A casing is secured to the base of the projectile body, enclosing the piston and vents prior to the ignition of propellant, and a separable joint is disposed between the casing and the base of the projectile body. Upon ignition of propellant in the combustion chamber, the projectile piston is forced down and the separable joint is caused to separate, leaving the casing in the barrel. After the piston completes exertion of propulsion force, combustion products of the ignition of propellant are expelled through the vents out of a lower end of the projectile and solid combustion byproducts from the ignition of the propellant are collected in the casing.

19 Claims, 11 Drawing Sheets

Related U.S. Application Data

(60) Provisional application No. 63/112,365, filed on Nov. 11, 2020.

(51) Int. Cl.
*F42B 5/18* (2006.01)
*F42B 5/045* (2006.01)

(56) References Cited

U.S. PATENT DOCUMENTS 2,426,239 A * 8/1947 Renner ..... F42B 5/10 102/439
2,926,566 A * 3/1960 Atkins ..... F42B 5/08 89/7
3,369,534 A * 2/1968 Crosman ..... F42B 6/00 102/293
3,738,272 A * 6/1973 Grosbard ..... F42B 5/10 102/433
3,916,793 A * 11/1975 Galluzzi ..... F42B 5/10 102/700
3,967,552 A * 7/1976 Settles ..... F42B 5/02 102/430
5,048,421 A * 9/1991 Swartout ..... F42B 5/18 102/431
5,060,574 A * 10/1991 Glish ..... F42B 30/003 102/388
5,208,423 A * 5/1993 Goetz ..... F42B 3/18 102/472
7,021,219 B1 * 4/2006 Dindl ..... F42B 5/045 102/470
8,342,097 B1 * 1/2013 Widder ..... F41A 19/47 102/431
9,500,420 B2 * 11/2016 Widder ..... F41A 21/00
9,759,499 B2 9/2017 Widdler et al.

* cited by examiner

PISTON/ROCKET PROJECTILE WITH SEPARABLE CASING

BACKGROUND OF THE INVENTION

1. Field of the Invention

The present invention pertains to the field of weaponry and, more particularly, to a piston/rocket projectile sed for non-lethal applications.

2. Description of the Related Art

The use of non-lethal projectiles in weapon systems include the use of frangible projectiles, which are designed to disintegrate upon target impact thereby minimizing penetration of the target. The use of these non-lethal projectiles can often require specialized equipment, meaning that a non-lethal weapon system cannot be used for lethal applications. Weapon launcher systems that are used for lethal applications may employ non-lethal ballistics such as beanbags or rubber projections, but lack the accuracy.

A launcher system employing a caseless piston/rocket projectile is described in U.S. Pat. No. 8,342,097 titled "CASELESS PROJECTILE AND LAUNCHING SYSTEM" and issued Jan. 1, 2013 presents a launcher having a barrel adapted to receive a projectile with a charge of propellant and a magazine adapted to hold additional projectiles. Each caseless projectile includes a piston shiftably mounted for movement relative to a main body. When propellant in the projectile is ignited, either mechanically or electrically, the propellant forces the piston forward from a retracted position during a period of initial thrust. After the piston moves to a fully extended position, the propellant exits through vent holes to provide an additional thrust for the projectile, while safely discharging pressure from within the projectile. When an electric current is used to initiate a primer and gas-generating solid propellant inside the projectile, electric current passes through the surfaces on the launcher barrel breech or bolt face into the projectile base and then to the primer and propellant. Once the projectile has been launched, no casing is left in the barrel that must be ejected, and the patent describes that reloading an additional projectile becomes relatively easy and the magazine simply pushes an addition projectile into firing position under the influence of a spring. The launcher system of U.S. Pat. No. 8,342,097 describes no means of extraction of the projectile from the barrel, even in the event of a misfire or if the launcher barrel needs to be emptied.

Furthermore, upon multiple firings of the launcher system described in U.S. Pat. No. 8,342,097, it has been discovered that carbon fouling occurs in the barrel bolt face. Since the propellant in the projectile is ignited electrically, such fouling reduces the conductivity of the surfaces contacting the projectile base and significantly limits the total number of projectile firings that may occur before the weapon will not have a sufficient electrical path to ignite the primer and propellant. The carbon deposit residue from repeated ignitions cakes onto the bolt face to a thickness of up to 0.020 in. (0.5 mm) and is extremely difficult to clean. While not being limited by theory, it is believed that such reside also includes aluminum either from the piston or lower combustion chamber melting and adding a plasma or other byproduct layer with the carbon deposited. As a result, cleaning is difficult under laboratory conditions, and is even more cumbersome in the field.

SUMMARY OF THE INVENTION

Bearing in mind the problems and deficiencies of the prior art, it is therefore an object of the present invention to provide a non-lethal projectile that may be fired within a launching system which reduces and/or eliminates fouling residue on a bolt face electrode inside the barrel chamber.

It is another object of the present invention to provide a non-lethal projectile that may be fired within a launcher system with improved accuracy.

A further object of the invention is to provide an apparatus and method of use directed to an electrically energized two stage piston/rocket projectile that captures the majority of ignition debris which may be readily evacuated with each round.

It is yet another object of the present invention to provide a method and apparatus that increases the duty cycle and fired projectile round count before operational field cleaning is needed.

Still other objects and advantages of the invention will in part be obvious and will in part be apparent from the specification.

The above and other objects, which will be apparent to those skilled in the art, are achieved in the present invention which is directed to a projectile for use with a launcher system having a barrel comprising a projectile body having a combustion chamber for propellant, a piston moveable to extend out of a base of the projectile as a result of ignition of propellant in the combustion chamber, and vents for expulsion of combustion products from the ignition of propellant out of the projectile base after initial movement of the piston. A casing is secured to the base of the projectile body, enclosing the piston and vents prior to the ignition of the propellant. A frangible joint is located between the casing and the base of the projectile body such that upon ignition of propellant within the combustion chamber, the piston is forced against the casing and causes the frangible joint to break. The casing is left in the barrel so that after the piston completes exertion of propulsion force against the casing, combustion products of the ignition of the propellant are expelled through the vents out of a lower end of the projectile and solid combustion byproducts from the ignition of the propellant are collected in the casing.

The projectile vents may be noncircular and formed in part by wall of an inner surface of the projectile body and in part by an outer surface of the piston. The projectile body may be formed of an electrically non-conductive material and propellant in the combustion chamber may be ignited electrically. The projectile may further include an electrode extending through the projectile body and into the combustion chamber. The projectile may include a gel-type propellant in the combustion chamber, and the electrode may extend into the gel-type propellant within the combustion chamber.

In addition, the projectile may include a nose portion at an end opposite the projectile base, the nose portion may have a rupture capsule disposed in an interior surface of the nose portion. The nose portion may be configured to open the rupture capsule upon contact with a target. The nose portion may include tear joints on an exterior surface to facilitate opening of the rupture capsule. The diameter of the nose portion may be smaller than the projectile body. The projectile may also include a sticky chip on the projectile body so that the sticky chip can adhere to a target upon impact with the projectile.

In a related aspect the present invention is directed to a method of launching a projectile from a launcher system having a barrel and a breech comprising providing a projectile body having a combustion chamber for propellant, a piston moveable to extend out a base of the projectile as a result of ignition of propellant in the combustion chamber, and vents for expulsion of combustion products from the ignition of propellant out of the projectile base after initial movement of the piston, as well as providing a casing secured to the base of the projectile body by a frangible joint between the casing and the projectile body base so that the casing encloses the piston and vents prior to the ignition of propellant. The method includes igniting propellant in the combustion chamber, causing the piston to be forced against the casing and causing the joint to break, thereby leaving the casing in the barrel such that after the piston completes exertion of propulsion force against the casing, combustion products of the ignition of propellant are expelled through the vents out of a lower end of the projectile and solid combustion products from the ignition of propellant are collected in the casing.

The frangible joint may comprise a flange in one of either the casing or projectile base, secured in a groove in the other of the casing and or projectile base, and wherein the flange may be sheared upon a predetermined force by the piston to separate the casing from the projectile body upon ignition of propellant in the combustion chamber and extension of the piston out of the projectile base.

In another aspect the present invention is directed to a projectile for use with a launcher system having a barrel comprising a projectile body having a combustion chamber for propellant, a piston moveable to extend out a base of the projectile as a result of ignition of propellant in the combustion chamber, and vents for expulsion of combustion products from the ignition of propellant out of the projectile base after initial movement of the piston, the vents being formed in part by walls of an inner surface of the projectile body and in part by an outer surface of the piston. The projectile further comprises a casing secured to the base of the projectile body by a joint between the casing and the base of the projectile body, so that the casing encloses the piston and vents prior to the ignition of propellant. Upon ignition of propellant in the combustion chamber, the piston extends such that the vents are exposed before the piston reaches the limit of its travel within the projectile body, whereupon combustion products of the ignition of propellant are expelled through the vents out of the lower end of the projectile.

Yet another aspect of the present invention is directed to a method of launching a projectile from a launcher system having a barrel comprising providing a projectile body having a combustion chamber for propellant, a piston moveable to extend out a base of the projectile as a result of igniting of propellant in the combustion chamber, and vents for expelling combustion products from the ignition of propellant out of the projectile base after initial movement of the piston, the vents being formed in part by walls of an inner surface of the projectile body and in part by an outer surface of the piston. The method includes providing a casing secured to the base of the projectile body by a joint between the casing and the base of the projectile body, so that the casing encloses the piston and vents prior to the ignition of propellant. The method further comprises igniting propellant in the combustion chamber, causing the piston to extend, exposing the vents the piston reaches the limit of its travel within the projectile, and expelling combustion products of the ignition of propellant through the vents out of the lower end of the projectile.

A further aspect of the present invention is directed to a projectile for use with a launcher system having a barrel comprising a projectile body formed of an electrically non-conductive material having a combustion chamber for propellant, the combustion chamber having a gel-type propellant therein and an electrode extending through the projectile body and into the combustion chamber for electrically igniting the gel-type propellant, a piston moveable to extend out a base of the projectile as a result of ignition of said gel-type propellant in the combustion chamber, and vents for expulsion of combustion products from the ignition of said gel-type propellant out of the projectile base after initial movement of the piston. A casing is secured to the base of the projectile body, which encloses the piston and vents prior to the ignition of the gel-type propellant. A frangible joint is located between the casing and the base of the projectile body such that upon ignition of the gel-type propellant by the electrode in the combustion chamber, the piston is forced against the casing and causes the joint to break, leaving the casing in the barrel. After the piston completes exertion of propulsion force against the casing, combustion products of the ignition of the propellant are expelled through the vents out of the lower end of the projectile and solid combustion byproducts from the ignition of the propellant are collected in the casing.

Still another aspect of the present invention is directed to a method of launching a projectile from a launcher system having a barrel comprising providing a projectile body formed of an electrically non-conductive material having a combustion chamber for propellant, the combustion chamber having a gel-type propellant therein and an electrode extending through the projectile body and into the combustion chamber for electrically igniting the gel-type propellant, a piston moveable to extend out a base of the projectile as a result of igniting the gel-type propellant in the combustion chamber, and vents for expelling combustion products from the ignition of the gel-type propellant out of the projectile base after initial movement of the piston. The method includes providing a casing secured to the base of the projectile body, thereby enclosing the piston and vents prior to the ignition of the gel-type propellant. The method further comprises providing a frangible joint between the casing and the base of the projectile body, and igniting the gel-type propellant by use of the electrode in the combustion chamber, thereby forcing the piston against the casing as a result of propulsion force and causing the frangible joint to break, leaving the casing in the barrel such that after the piston completes exerting propulsion force against the casing, expelling combustion products of the ignition of the propellant through the vents out of the lower end of the projectile such that solid combustion byproducts from the ignition of the propellant are collected in the casing.

In another aspect the present invention is directed to a projectile for use with a launcher system having a barrel comprising a projectile body formed of an electrically non-conductive material having a combustion chamber for propellant, the combustion chamber having a gel-type propellant therein and an electrode extending through the projectile body and into the combustion chamber for electrically igniting the gel-type propellant, a piston moveable to extend out a base of the projectile as a result of ignition of the gel-type propellant in the combustion chamber, and vents for expulsion of combustion products from the ignition of the gel-type propellant out of the projectile base after initial movement of the piston. A non-electrically conductive layer is located between the gel-type propellant and the end of the chamber opposite the piston, the non-electrically conductive layer covering at least a portion of a width of the combustion chamber. The non-electrically conductive layer has an opening therein through which extends the electrode. An electrically conductive layer covering at least a portion of the width of the combustion chamber is also included, and is disposed between the non-electrically conductive layer and the gel-type propellant so that the electrically conductive layer is in electrical contact with an end of the electrode. Upon ignition of the gel-type propellant by the electrode and electrically conductive layer in the combustion chamber, the piston is forced outward from the lower end of the projectile and subsequently combustion products of the ignition of the gel-type propellant are expelled through the vents out of the lower end of the projectile.

The non-electrically conductive layer may cover the entire width of the combustion chamber, or may include projections extending along the sidewalls of the combustion chamber. The electrically conductive layer may cover the entire width of the combustion chamber, or may include a projection extending therefrom in contact with the end of the electrode.

A further aspect of the present invention is directed to a method of launching a projectile from a launcher system having a barrel comprising providing a projectile body formed of an electrically non-conductive material having a combustion chamber for propellant, the combustion chamber includes a gel-type propellant therein and an electrode extending through the projectile body and into the combustion chamber for electrically igniting the gel-type propellant, a piston moveable to extend out a base of the projectile as a result of igniting the gel-type propellant in the combustion chamber, and vents for expulsion of combustion products from the ignition of the gel-type propellant out of the projectile base after initial movement of the piston. The method includes providing a non-electrically conductive layer between the gel-type propellant and the end of the chamber opposite the piston, the non-electrically conductive layer covering at least a portion of a width of the combustion chamber, the non-electrically conductive layer having an opening therein through which extends the electrode. The method further comprises providing an electrically conductive layer covering at least a portion of the width of the combustion chamber, the electrically conductive layer disposed between the non-electrically conductive layer and the gel-type propellant in electrical contact with an end of the electrode. The method further includes igniting the gel-type propellant by use of the electrode and electrically conductive layer in the combustion chamber, forcing the piston outward from the lower end of the projectile and subsequently expelling combustion products of the ignition of the gel-type propellant through the vents out of the lower end of the projectile.

The invention in another aspect is directed to a projectile for use with a launcher system having a barrel comprising a projectile body having a combustion chamber for propellant, a piston moveable in one direction to ignite the propellant in the combustion chamber and in an opposite direction to extend out a base of the projectile as a result of ignition of propellant in the combustion chamber, and vents for expulsion of combustion products from the ignition of propellant out of the projectile base after initial movement of the piston. A casing is secured to the base of the projectile body enclosing the piston and vents prior to the ignition of propellant, and a separable joint is between the casing and the base of the projectile body. Upon ignition of propellant in the combustion chamber by movement of the piston in the one direction, the piston is forced in the opposite direction and causes the separable joint to separate, leaving the casing in the barrel such that after the piston completes exertion of propulsion force, combustion products of the ignition of propellant are expelled through the vents out of a lower end of the projectile and solid combustion byproducts from the ignition of the propellant are collected in the casing. The propellant in the combustion chamber may be ignited mechanically.

In a corresponding aspect, the present invention is directed to a method of launching a projectile from a launcher system having a barrel and a breech comprising providing a projectile body having a combustion chamber for propellant, a piston moveable in one direction to ignite the propellant in the combustion chamber and in an opposite direction to extend out a base of the projectile as a result of ignition of propellant in the combustion chamber, and vents for expulsion of combustion products from the ignition of propellant out of the projectile base after initial movement of the piston. A casing is secured to the base of the projectile body by a separable joint between the casing and the projectile body base, the casing enclosing the piston and vents prior to the ignition of propellant. The method includes moving the piston in the one direction to ignite propellant in the combustion chamber, causing the piston to be forced in the opposite direction and causing the joint to separate, thereby leaving the casing in the barrel. After the piston completes exertion of propulsion force, combustion products of the ignition of propellant are expelled through the vents out of a lower end of the projectile and solid combustion products from the ignition of propellant are collected in the casing.

In both the apparatus and method aspects of the invention as described above, the propellant in the combustion chamber may be ignited by an electrically- or mechanically-initiated primer. The separable joint may be separated upon a predetermined force by the piston to separate the casing from the projectile body upon ignition of propellant in the combustion chamber and extension of the piston out of the projectile base. The separable joint may comprise a flange in one of the casing or projectile base secured in a groove in the other of the casing or projectile base, or may comprise a reverse or conical joint flange between the casing and projectile base.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF AN EMBODIMENT OF THE INVENTION

Figure 1:
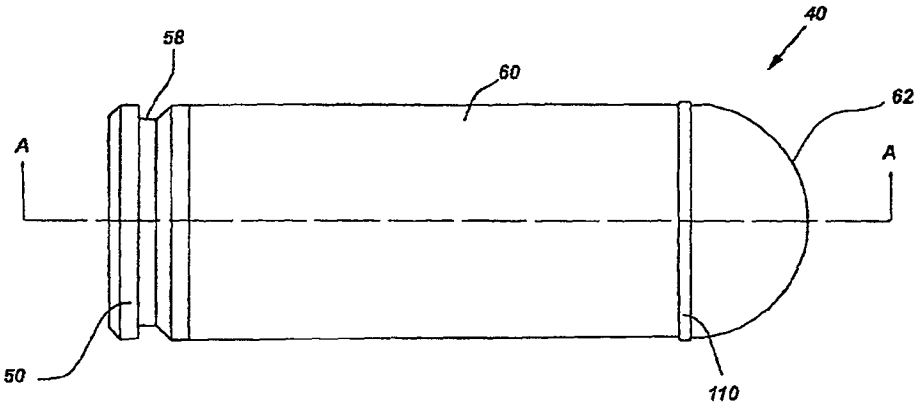
FIG. 1 is a side view of the projectile of the present invention.

In describing the embodiment of the present invention, reference will be made herein to FIGS. 1-21 of the drawings in which like numerals refer to like features of the invention.

Certain terminology is used herein for convenience only and is not to be taken as a limitation of the invention. For example, words such as "upper," "lower," "left," "right," "horizontal," "upward," "downward," or the like, merely describe the configuration shown in the drawings. Indeed, the referenced components may be oriented in any direction and the terminology, therefore, should be understood as encompassing such variations unless specified otherwise. For purposes of clarity, the same reference numbers will be used in the drawings to identify similar elements.

Additionally, in the subject description, the words "exemplary," "illustrative," or the like, are used to mean serving as an example, instance, or illustration. Any aspect or design described herein as "exemplary" or "illustrative" is not necessarily intended to be construed as preferred or advantageous over other aspects or design. Rather, the use of the words "exemplary" or "illustrative" is merely intended to present concepts in a concrete fashion.

Figure 2:
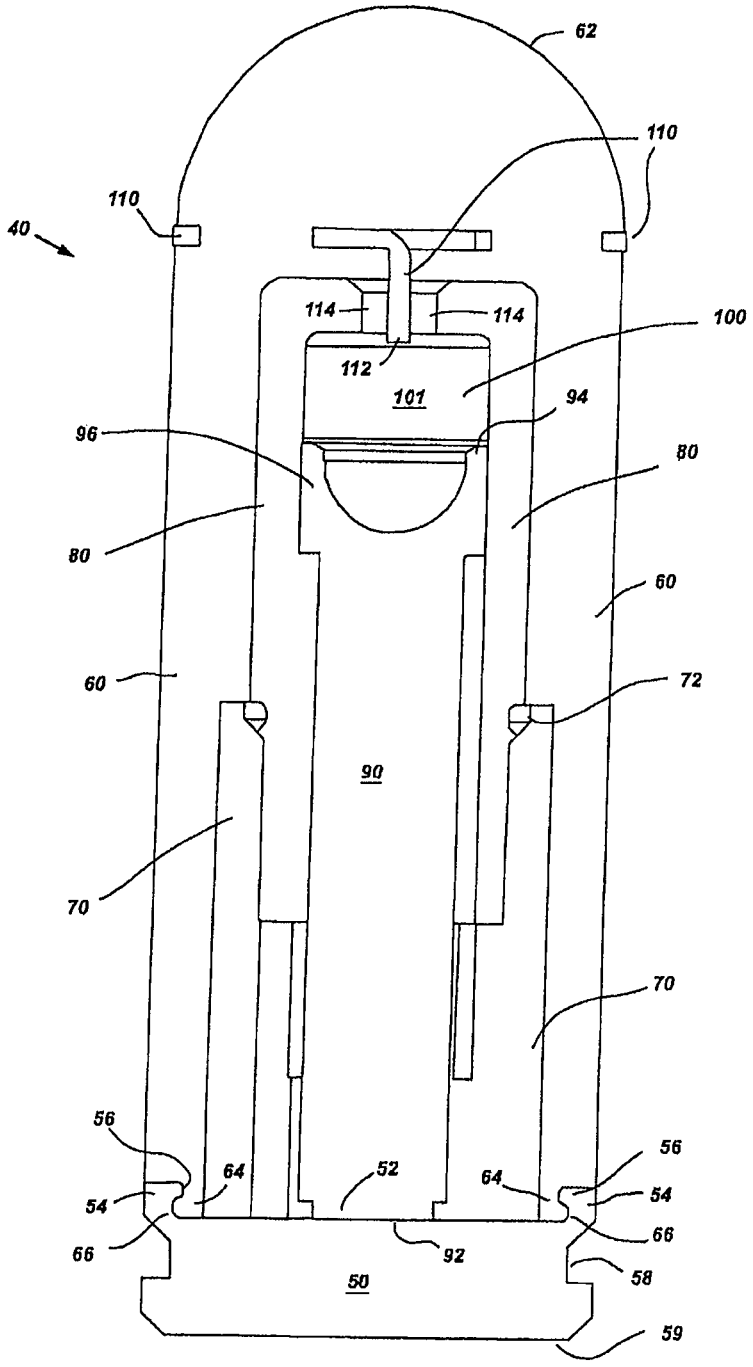
FIG. 2 is a cross-sectional view taken along the A-A axis of FIG. 1.

The exemplary piston/rocket projectile 40 of the present invention as shown in FIGS. 1 and 2 includes a cylindrically shaped outer body 60 having an ogive or blunt shaped dome 62 at its nose or front end and a casing 50 secured to body 60 at its opposite, lower or base end to seal the projectile base 61. Casing 50 has a flat base 59 and on its periphery above the base, an extractor groove 58 and an outer cylindrical extension 54 above the groove. Inserted within body 60 are lower inner sleeve 70 and upper inner sleeve 80, which each have cylindrically shaped inner surfaces that slidingly receive piston 90, which may slide therein with a slight interference. Body 60 may be made from any suitable material such as a composite or polymer. Lower inner sleeve 70 may be made from a metal or alloy such as extrudable 6061-T6 aluminum. Upper inner sleeve 80 may be made from a metal or alloy such as steel. Piston 90 may be made from a metal or alloy such as 7075-T6 aluminum. Casing 50 may be made from a metal or alloy such as aluminum or may have a composite construction of a polymer with a metallic insert molded into a plastic casing body with annular ring, as discussed further below.

Figure 8:
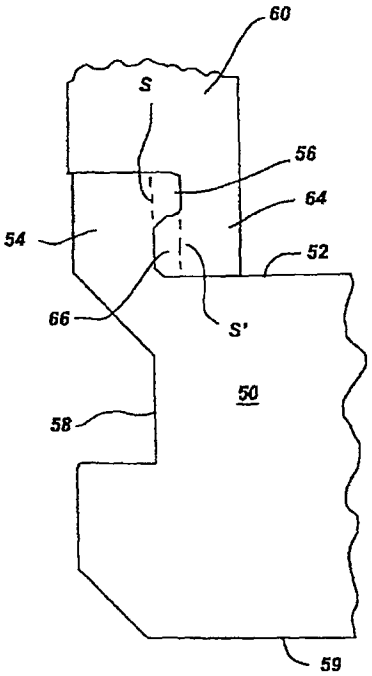
FIG. 8 is an enlarged cross-sectional view of the casing and body configuration of the projectile of the present invention.

The connection or joint between projectile body 60 and casing 50 is achieved by an interlocking, annular structure comprising a cylindrical extension 64 extending from the lower or rear end of body 60 within an outer cylindrical extension 54 extending up or forward from casing 50, with the outer diameter of extension 54 being comparable to the outer diameter of projectile body 60, as shown in FIGS. 2 and 8. Outwardly extending body flange 66 and inwardly extending casing flange 56 fit snugly within complimentarily shaped grooves in casing extension 54 and body extension 64, respectively. The flanges and grooves, positioned adjacent the outer diameter of casing 50 and body 60, are configured to be able to have a snap fit as they are pushed together during assembly of the casing to the projectile body. While the above flange and groove configuration are preferred, other configurations are not precluded, for example, having the body flange extending inwardly and casing flange extending outwardly. It should be understood by a person skilled in the art that any configuration sealing the casing 50 and the body 60 could be permissible, including acceptance of a flange within an annular channel.

Figure 4:
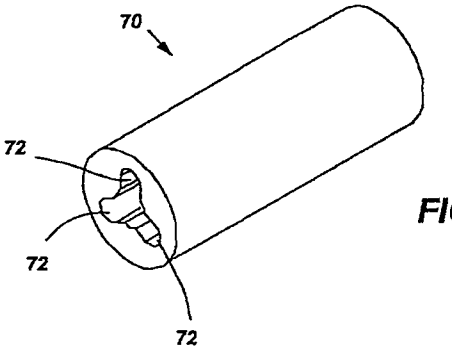
FIG. 4 is a perspective view of the lower inner sleeve of the present invention.
Figure 3:
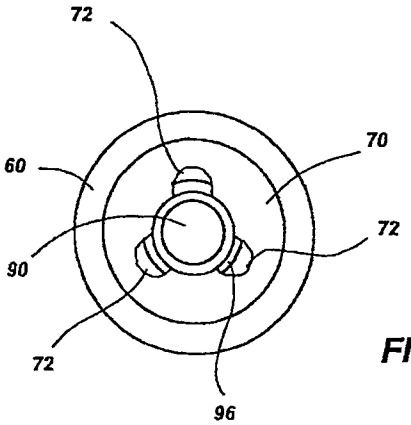
FIG. 3 is a bottom view of the projectile of the present invention having the casing removed for clarity.

Lower inner sleeve 70 is received in a tight fit within the lower portion of outer body 60. Upper inner sleeve 80 is likewise received in a tight fit within the upper portion of the outer body 60, and the lower end of sleeve 80 is stepped in with a smaller diameter to fit within the upper end of sleeve 70. In some embodiments, upper sleeve 80 and lower sleeve 70 may be of a single construction within body 60. Piston 90 has a cylindrical elongated body sized to slide freely within the inner bore of lower inner sleeve 70 and a cylindrical head 96 of larger diameter sized to slide freely within the inner bore of upper inner sleeve 80. The cylindrical construction of piston 90 and head 96 is exemplary only, and may be of any construction so that sliding within the inner bore of sleeve 80 is permitted. As depicted in FIGS. 3 and 4, channels 72 are formed in the inner surface of lower inner sleeve 70, for example by extrusion along the entire inner bore thereof, and are enclosed along their length at the upper end in part by the stepped-in portion of upper inner sleeve 80 and at the lower end in part by the outer surface of the elongated body of piston 90. The channels 72 in the lower portion of sleeve 70 form in cross-section non-circular passageways along approximately one-half of the length of the sleeve 70. Three of these channels 72 are shown in the example as a "Y" shape equally spaced around the periphery of piston 90. These lower end channels 72 and the mating portions of the outer wall of the piston 90 elongated body form gas vents, as will be described further below.

Figure 5:
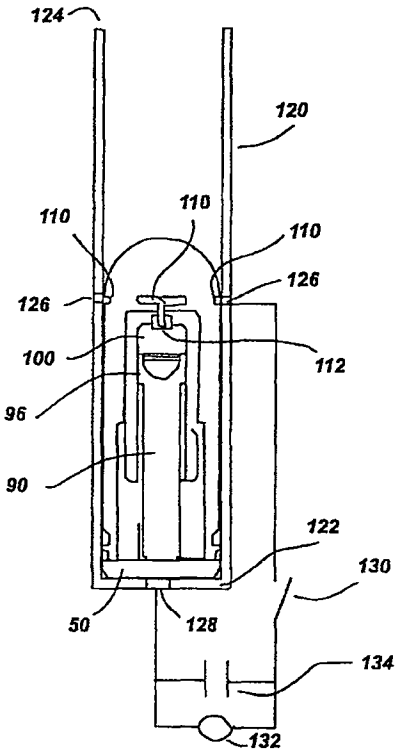
FIG. 5 is a cross-sectional view of the projectile as initially loaded within the launching system, including a schematic presentation of the launching system's circuit diagram.

Combustion chamber 100 as shown in FIGS. 2 and 5 is formed between the upper end of the interior of upper inner sleeve 80 and the upper end 94 of piston head 96. Propellant 101 in combustion chamber 100 may be electrically ignited by applying a current from a battery 132 and capacitor 134 power source via a circuit extending along or through the launcher barrel (FIG. 5). As shown in the schematic, one leg of the circuit in the launcher barrel connects via contact 126 with an upper portion of projectile body 60. A metal electrode 110 or any other suitable conductive means is provided with an exposed outer end portion adjacent ogive 62 that connects to contact 126 and extends inwardly and has a 90-degree turned contact tab that travels through an opening in the forward end of upper inner sleeve 80. The opposite inner end portion 112 of electrode 110 makes contact with an electronic primer at the forward end of combustion chamber 100. Electrode 110 may be inserted or molded into body 60. The other ground leg of the circuit in the launcher barrel includes contact 128 that connects with casing 50, which is in contact with the lower end 92 of piston 90. If casing 50 is not made from a metal or alloy, it may have a composite construction of a polymer or similarly non-conductive material with a metallic electrode slug or terminal bridge insert forming contact 128 molded therein and extending from the outer surface of casing base 59 to the casing inner surface 52 for conductivity with the lower end of piston 90. Because of the use of electrode 110 as the first circuit leg, no electrically insulating coating is needed on piston 90 as part of the ground leg.

When projectile 40 is loaded into launcher 120, ignition of the propellant is achieved by closing switch 130 and discharging the ignition circuit which travels in one leg from a contact 126 in the launcher barrel through electrode 110 and in the other ground leg from a contact 128 in the launcher barrel breech through the casing 50 and piston 90. For example, a 150V capacitor 134 may be discharged to supply current to energize a primer, such as the Remington ETRONX primer, and ignite the propellant charge in the combustion chamber 100. It should be understood by those skilled in the art that the use of 150V capacitors to energize Remington ETRONX primers are only one example of providing ignition of a propellant charge within a combustion, and that other ways of providing a propellant charge within a combustion chamber are not precluded.

Figure 6:
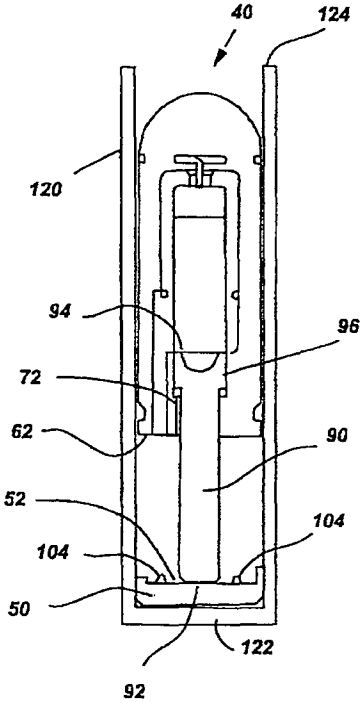
FIG. 6 is a cross-sectional view of the projectile within the launching system after initial ignition of the projectile.

FIG. 6 depicts the initial piston thrust portion of the launch of projectile 40 from launcher 120. As the propellant explodes, the hot combustion gases 102 force piston 90 downward. Instead of directly contacting the barrel breech face as in U.S. Pat. No. 8,342,097, piston lower end 92 instead contacts casing inner surface 52 and applies force against the casing 50 structure to propel the remainder of the projectile forward. The joint between the projectile body 60 and casing 50 provides a type of shear flange in which column thickness of the joint materials regulates shear strength to control the release of the projectile from the casing at optimal internal pressures. In the embodiment shown in FIG. 9, the casing flange 56 is configured to be frangible, i.e., to shear at a desired force substantially along line S, for example, 5 to 8 lbs. of linear force in the direction along the axis of the projectile. The joint may be configured via selection of materials and shape and thickness to achieve any desired separation force. Alternatively, the projectile body flange 66 may be configured to be frangible to shear along line S'. Other frangible geometrical configurations may be used in place of the joint configuration shown herein. For example, the shear flange may be interrupted and extend around only a portion of the circumference of the casing and projectile body, to reduce the force needed to separate the joint. The length of casing 50 relative to the length of projectile body 60 may be increased beyond that shown, so that the height of casing extension 54 may be greater than that depicted in the drawings. Thus, it will be understood by a person skilled in the art that other configurations of releasing a casing from a projectile are not precluded, and the above cited configurations are exemplary. A shear flange might be obsoleted because of retention within the base cap; or might be minimized in elevation to just hold the piston in assembly.

Figure 7:
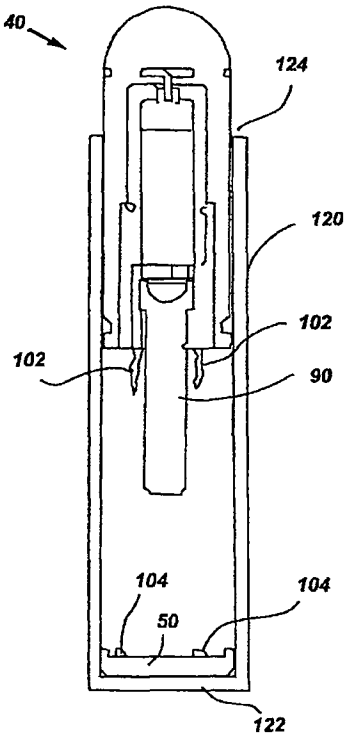
FIG. 7 is a cross-sectional view of the projectile within the launching system as the projectile is leaving the launching system.

After the shear flange S of the joint between casing 50 and projectile body 60 is broken, projectile 40 is free to move forward by virtue of the force applied by piston 90 out of the projectile base 61 against casing 50, the latter being thrust against and remaining in the breech of the launcher barrel. As the piston initially travels downward and rearward, mechanical force of the piston thrust alone propels the projectile 40, which initially carries with it the sheared-off casing flange portion 56 of casing extension 54. As shown in FIG. 6, before the piston reaches the limit of its travel, at approximately 90% of the total distance of travel of the piston, the upper or forward end 94 of the piston passes the lower end of upper inner sleeve 80 and reaches the forward end of gas channels or vents 72 formed in lower inner sleeve 70, which extend to the lower end of projectile body 60. The exposure of the three channels 72 shown in the "Y" shape around the periphery of piston 90 as the top of piston passes by act as valves for the second stage propulsion of the projectile. Once channels and vents 72 begin to open to the exploding propellant, the combustion products 102 expel out of the lower end of the vents 72 of the projectile, and further expel rocket energy from the ignition charge. Piston 90 continues to move downward until it is fully extended, as shown in FIG. 7. Once the piston 90 is fully extended and the piston base 92 lifts off and separates from contact with the casing 50, the force of the combustion gases 102 out of the base 91 of projectile 40 alone add further force to propel the projectile from the launcher barrel 124, as shown in FIG. 7. For non-lethal rounds, the projectile speed may be in the range of about 300-400 ft./sec. The barrel may have a rifled interior surface to impart twist to the projectile as it moves through during the rocket propulsion stage of launch.

With a typical charge of 35 mg of gunpowder, and even if the composition is high in nitrogen-based compounds, there still is produced considerable carbon and other solid combustion residue 104, which is captured in the defined contained area inside the internal cup shape of broken-off casing 50 as shown in FIG. 7. The casing 50 remaining in the launcher barrel breech 122 provides the means to contain and hold the burnt, expelled gunpowder residue 104 of each projectile round, thereby keeping the barrel 120 chamber relatively clean and greatly extending the duty/cleaning cycle of the launcher.

As an alternative to the ETRONX primer and propellant system described above, a gel-type explosive may be employed, which combines the primer and main charge of the propellant. In such case, as shown in FIG. 2, the primer may be eliminated, the electrode may be surrounded by annular insulator 114, and the electrode end 112 in combustion chamber 100 may be extended into a gel-type propellant itself to ignite the propellant 101.

Figure 10:
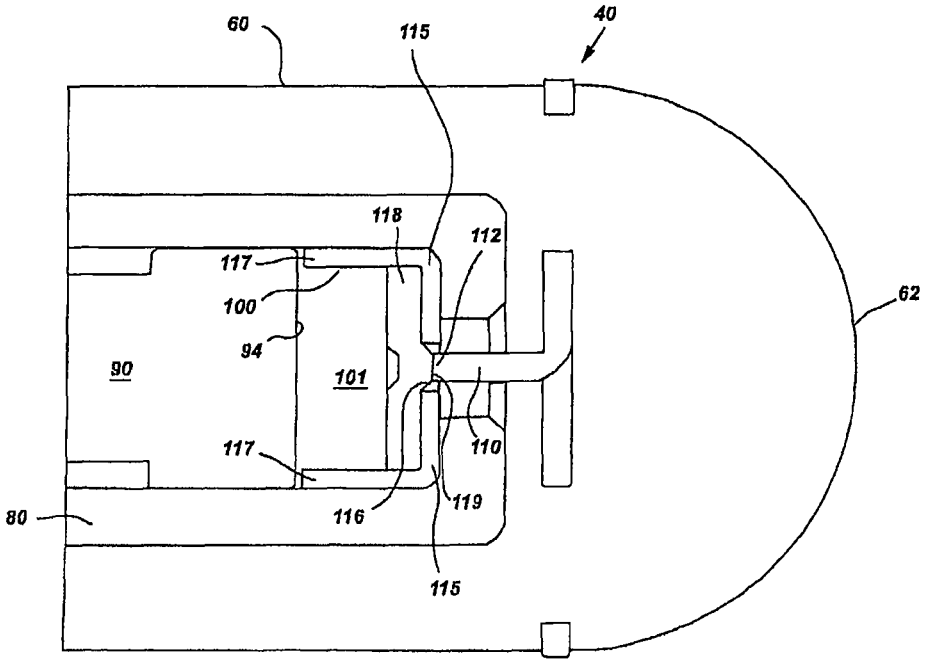
FIG. 10 is an enlarged cross-sectional view of the projectile ogive section.
Figure 11:
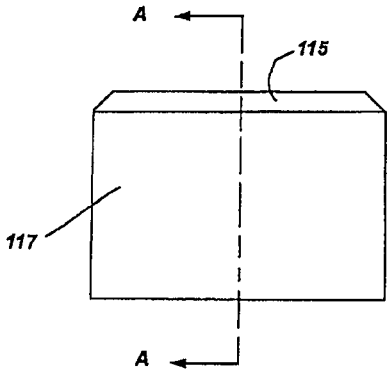
FIG. 11 is a side view of the electrically non-conductive layer.
Figure 12:
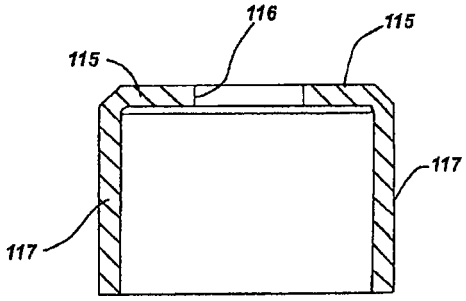
FIG. 12 is a cross-sectional view taken along the A-A axis of FIG. 11.
Figure 13:
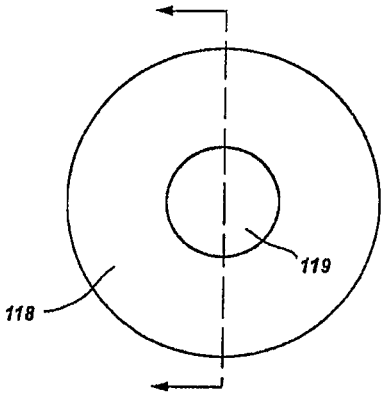
FIG. 13 is a top view of the electrically conductive layer.
Figure 14:
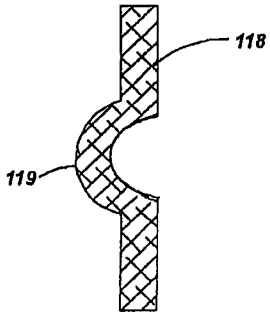
FIG. 14 is a cross-sectional view taken along the A-A axis of FIG. 13.

In a further modification shown in FIG. 10, an electrically non-conductive layer 115 (see also FIGS. 11 and 12) is disposed between the gel-type propellant 101 and the upper end of combustion chamber 100 opposite upper end 94 of piston 90, and has a central opening 116 for receiving electrode end 112. Electrically non-conductive layer 115 may be made of a polymer with a thickness of approximately 0.15 in. (0.4 mm) and may form a layer within combustion chamber 100 extending up to the entire width of combustion chamber 100, and may further extend 117 in a cup shape (FIGS. 11 and 12) along the side walls of combustion chamber 100. An electrically conductive layer 118 is disposed adjacent electrically non-conductive layer 115 and may similarly extend up to the entire width of the combustion chamber to form a layer between the electrically non-conductive layer and the gel-type propellant 101. Electrically conductive layer 118, shown in the form of a metal disk or plate of stainless steel or aluminum of approximately 0.3 in. (0.8 mm) thickness (FIGS. 13 and 14), may have a stamped or otherwise formed projection 119 extending from the center of the surface opposite the propellant to facilitate good electrical contact with end 112 of electrode 110. Electrically non-conductive layer 115 and side walls 117 form an insulative liner to ensure that the igniting electrical current is transferred directly to the gel-type propellant 101 and not dissipated into the metal walls of the upper portion of inner sleeve 80 surrounding the combustion chamber 100. Electrically conductive layer or plate 118 ensures that the igniting electrical current is transferred uniformly along the end of the gel-type propellant within the upper end of the combustion chamber and further acts as a pressure-directing shutoff, to ensure that the force of the ignited combustion products is in the direction of piston 90.

The gel-type explosive provides an improvement over gunpowder-type primer and propellant systems because the pressure vs. time curve is flatter. For low velocity projectiles, the ignition thrusts the projectile into the rifling of the barrel with a slower, more uniform combustion rate. As a result of the elimination of the ETRONX primer ignition and the direct contact of the electrode 110 or the electrically conductive disk 118 with the gel propellant 101, the energy is transferred more rapidly to the piston, thereby increasing efficiency of the piston propulsion stage and increased velocity with less propellant. Additionally, the combustion byproducts are water vapor, hydrogen and reduced solids, so that less residue remains in the barrel and weapon duty cycles is increased.

Figure 16:
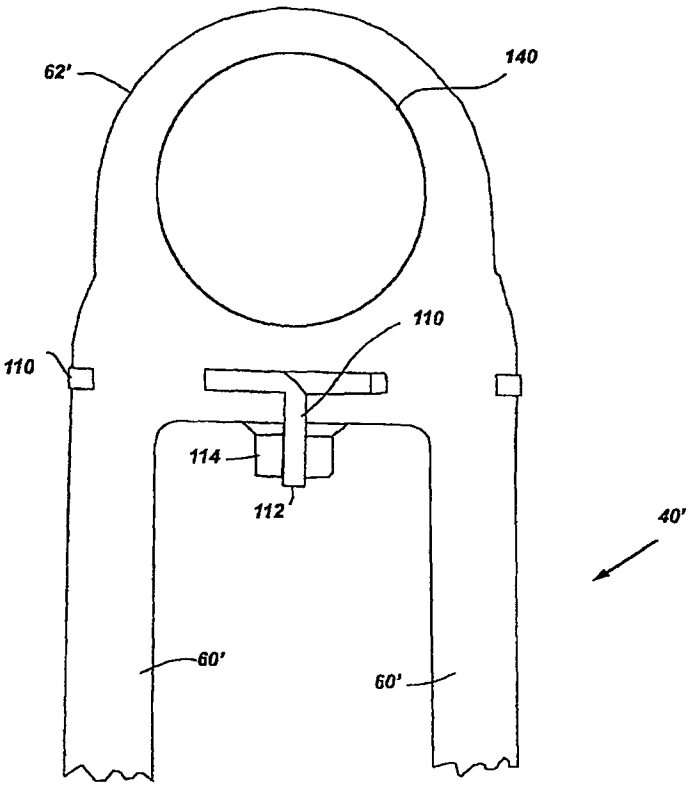
FIG. 16 is an enlarged cross-sectional view of the nose of the projectile in FIG. 15.
Figure 15:
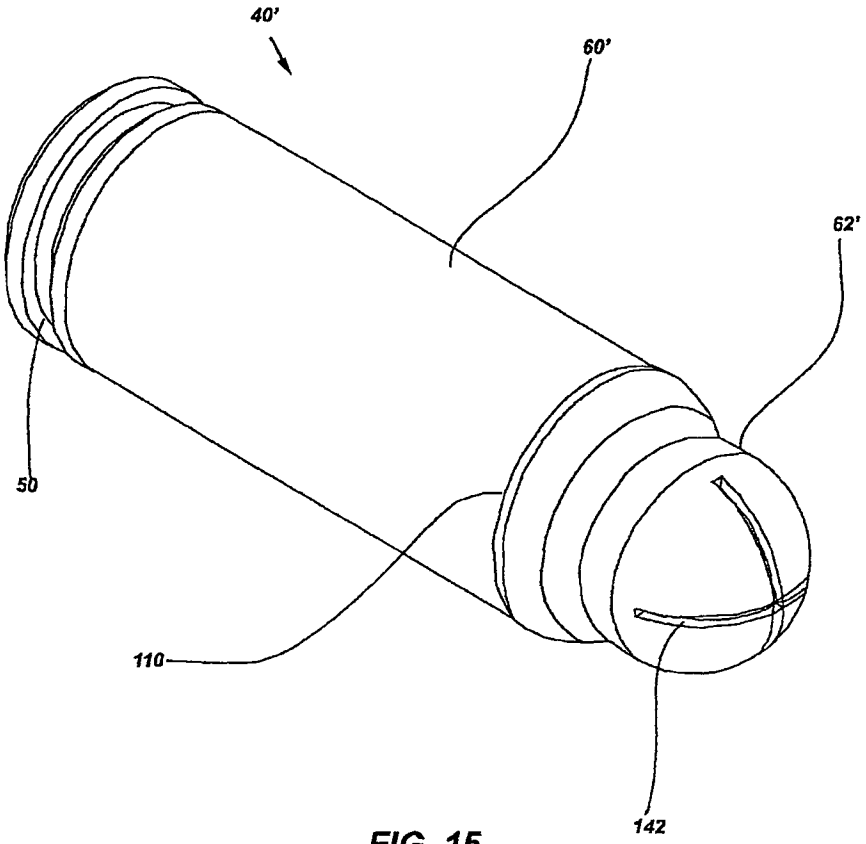
FIG. 15 is a perspective view of an embodiment of the non-lethal projectile of the present invention.

The domed ogive of projectile 40 shown may be further modified in accordance with the intended use of the projectile. While the projectile shown in FIGS. 1-14 may be employed as a non-lethal projectile with the blunt trauma ogive 62 and body 60, further modifications may include the additions of a die marker round, as shown in FIGS. 15 and 16. Ogive 62' of projectile 40' may house, for example, a ⅜ in. diameter rupture capsule 140 that can hold various marker/paint formulation, as shown in FIG. 16 in cross-section. As best shown in FIG. 15, the nose 62' cover may also be pre-molded with tear joints 142 extending from the tip of the nose down a portion of the side, to aid in opening of capsule 140 upon contact with the intended target. In some embodiments, the die marker nose 62' may have a smaller diameter than that of the body 60' so that the rifling of the launcher barrel does not disturb the perforations 142 during loading and firing of round 40'. The die marker round 40' has the same headspace as the blunt trauma jacket 40, thus permitting interchangeability of rounds 40,40' within a single launching system. The different use body jackets 60, 60' may be configured to fit over a common combustion assembly of upper inner sleeve 80, lower inner sleeve 70 and the combustion chamber 100 and piston 90 therein, and to connect the lower end to a common casing 50. Additionally, other variant body jackets 60, 60' may include a sticky chip that will have some electronics with an adhesive to stick to a target, to monitor location thereof.

The casing may be headstamped with identifying information such as caliber, round type, manufacturing date and/or other data. The casing also hermetically seals the projectile round from air or water invasive contamination, thus extending the shelf life significantly.

Upon activation of a bolt handle, slide, charging handle, or other similar device known in the art, the casing may be extracted at the end of the bolt stroke via a knockout rod and extractor system engaging casing extractor groove 58. Casing groove 58 or another extractor groove molded or formed into the projectile body or jacket 60 may be used to enable mechanical means to eject a live cartridge that has malfunctioned.

Figure 17:
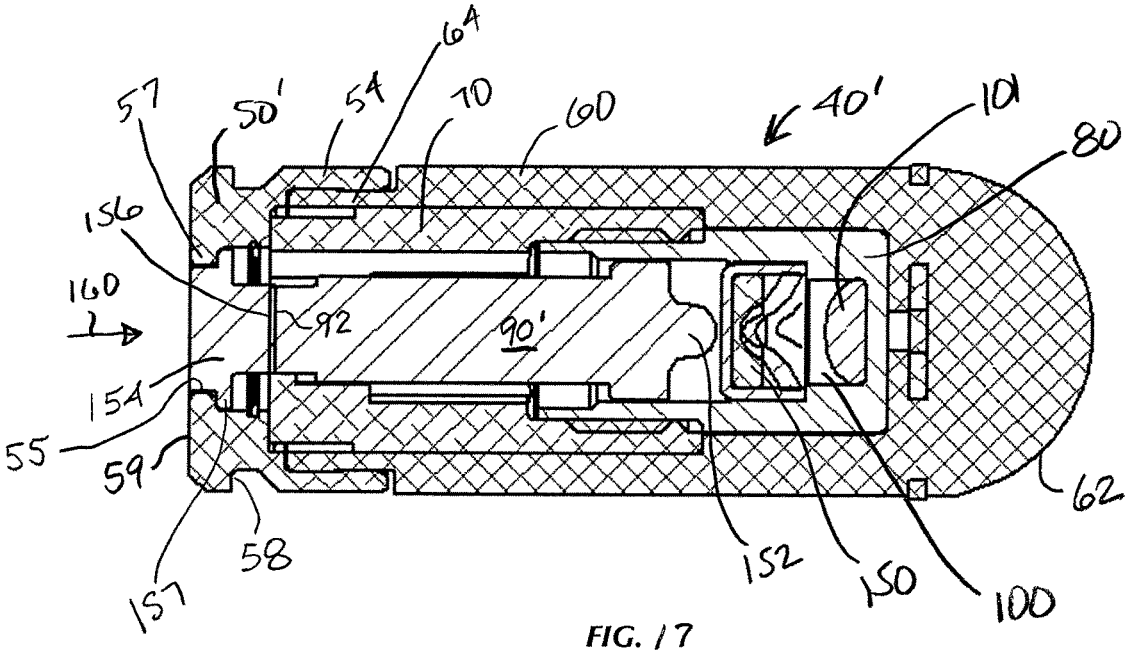
FIG. 17 is a cross-sectional view of another embodiment of the projectile of FIG. 1, with an alternate mechanically-initiated primer.

A mechanically-initiated percussion primer may be used in place of the ETRONX primer described previously. In this embodiment of the projectile 40' of the present invention as shown in FIG. 17, the piston 90' has a striker feature 152 extending away from piston upper end 94, and the primer 150 in the primer cup is rotated around to face the rear of the projectile 40'. Casing 50' includes a central opening 55 to receive a cylindrical transfer button 154, slideably captured and moveable linearly along the projectile longitudinal axis, which may be struck in the direction of arrow 160 on transfer button base 158 by an otherwise conventional striker mechanism in the launcher breech (not shown) and move forward to cause the top face 156 to strike the base 92 of piston 90'. A transfer button shoulder or flange 157 extends outwardly to a larger diameter than a casing step 57 of casing central opening 55 to prevent the transfer button from moving downward out of the casing 50'. The impact of transfer button 154 then causes piston 90' to move forward toward primer 150, so that the piston striker 152 may contact the surface of the primer cup to crush and ignite the primer fulminate (i.e., a moderately insensitive explosive) and mechanically ignite the propellant 101 in combustion chamber 100, whereby the combustion gasses force the primer cup against piston 90' and consequently the piston downward against transfer button 154 and casing 50'. The structure and operation of the projectile lower extension 64 and cylindrical extension 54 of casing 50' to hold and then separate the projectile body and casing upon ignition of the propellant are described further below, but may also be otherwise as described above in connection with the electronic primer version of projectile 40, for example as shown in FIGS. 8 and 9.

Figure 18:
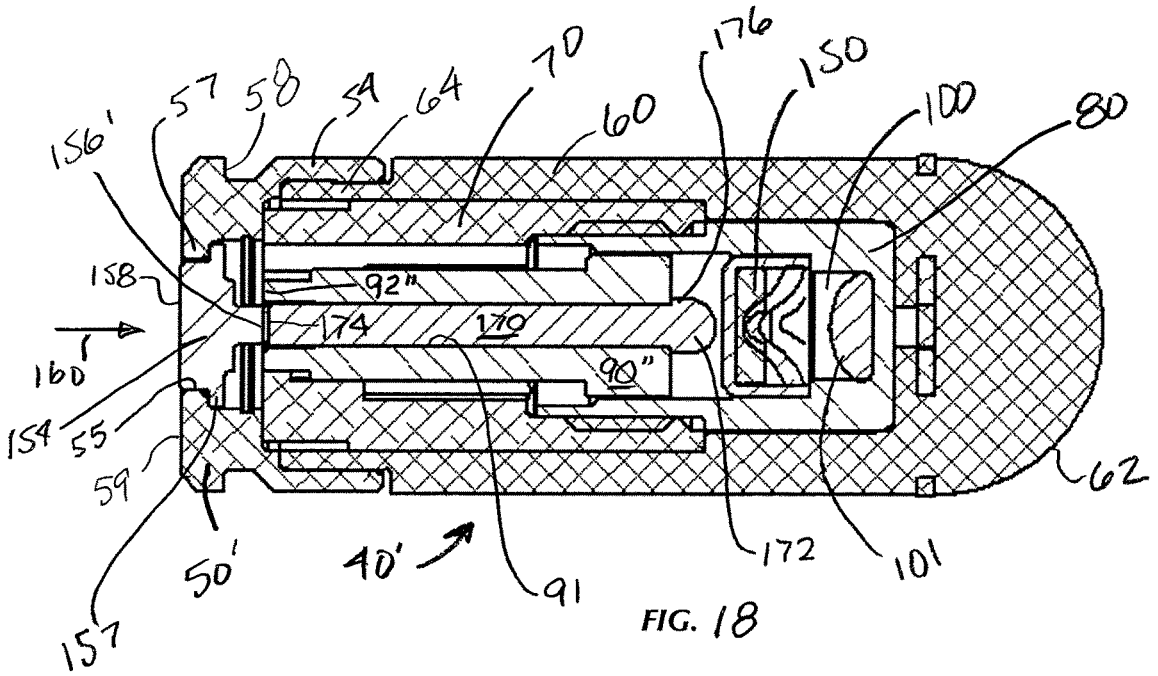
FIG. 18 is a cross-sectional view of a further embodiment of the projectile of FIG. 1, with an alternate mechanically-initiated primer.

Another embodiment of the alternate mechanically-initiated primer mechanism in projectile 40' is shown in FIG. 18. Casing 50' includes transfer button 154 in opening 55 as shown in FIG. 17, but with a smaller diameter top surface 156'. Transfer button top surface 156' is forced by impact of the striker in direction 160 to contact the base 172 of a cylindrical transfer-striker pin 170 slideable within a central opening 91 in the body of piston 90". Striker-transfer pin 170 is then projected forward within piston 90" until striker-transfer head 172 strikes and ignites primer 150. Transfer-striker 170 has a lower mass than piston 90' in FIG. 17, and likely lower friction in the striker column. The ignition of the propellant in chamber 100 then forces striker-transfer 170 downward back into piston 90" and piston 90" downward so that piston base 92" contacts and forces against transfer button 154 and casing 50'. Casing step 57 prevents the transfer button from moving downward out of the casing opening 55 and shoulder 176 at the base of transfer-striker head 172 prevents the striker-transfer pin from sliding downward and out of piston 90". Again, the structure and operation of the projectile lower extension 64 and casing extension 54 to hold and then separate the projectile body and casing upon ignition of the propellant is described further below, but may also be otherwise as described above in connection with the electronic primer version of projectile 40.

Figure 19:
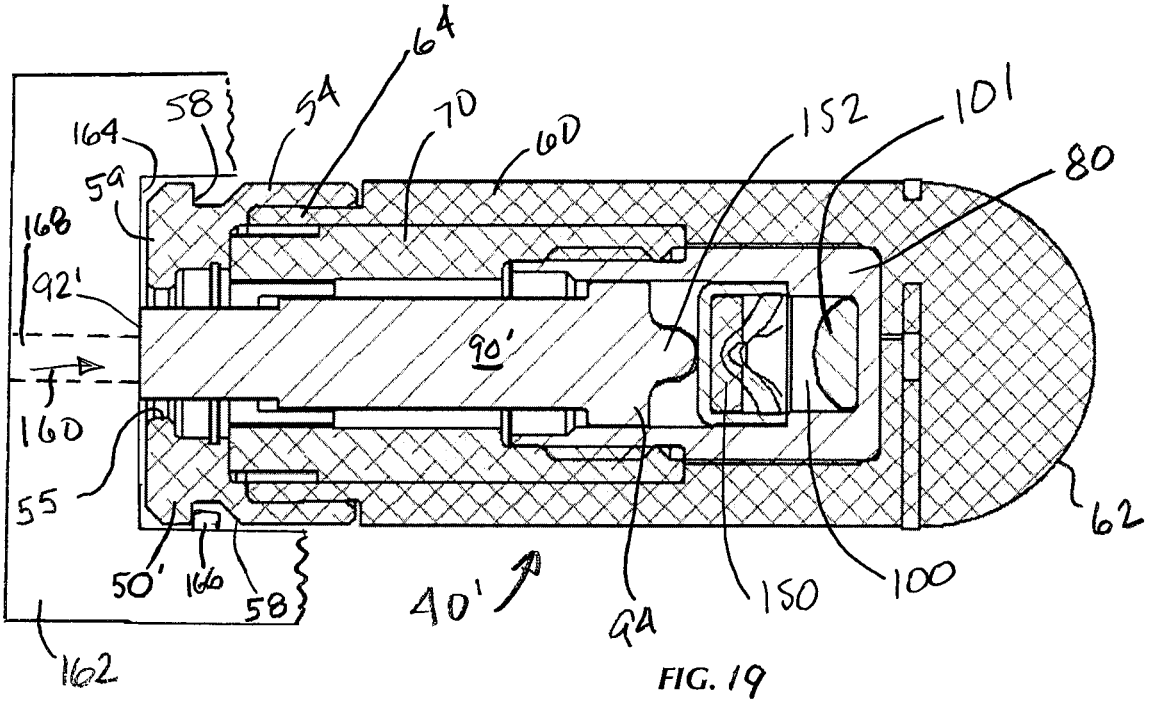
FIG. 19 is a cross-sectional view of yet another embodiment of the projectile of FIG. 1, with an alternate mechanically-initiated primer.
Figure 20:
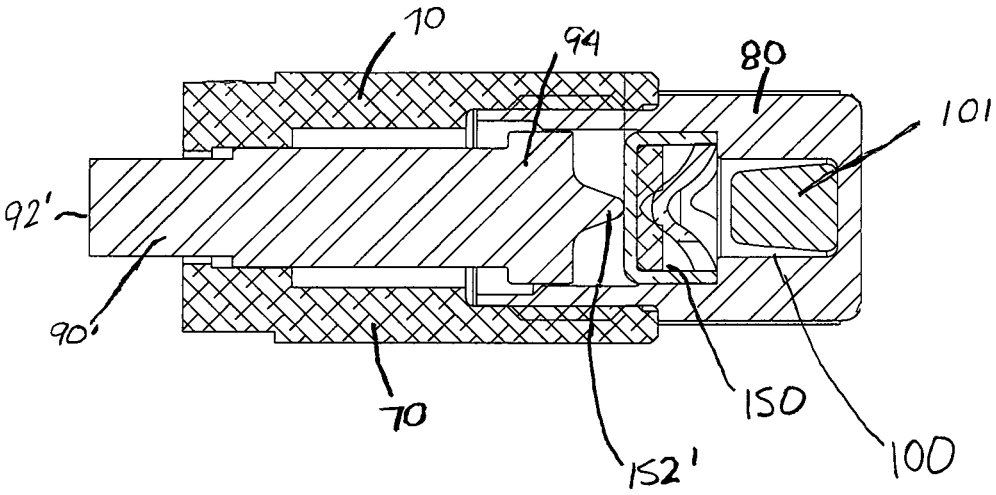
FIG. 20 is a cross-sectional view of the interior portion of the projectile of FIG. 19, with another alternate mechanically-initiated primer.

FIGS. 19 and 20 depict further alternate mechanically-initiated primer embodiments of projectile 40' wherein the transfer button shown in FIGS. 17 and 18 is removed, and the base 92' of piston striker 90' is extended to occupy the space once occupied by the transfer button. As shown in FIG. 19, casing 50' central opening 55 is sized to receive and permit access to base 92' of piston 90' by movement in the direction of arrow 160 of an otherwise conventional striker mechanism 168 in the launcher 162 barrel breech. This configuration removes one joint, transfer button 154, whereby the impact of the striker directly causes piston 90' to move forward toward mechanical primer 150, thereby simplifying the energy transfer from the striker to the primer 150. In FIG. 19, piston striker 152 has a constant radius, and in FIG. 20 (showing casing 50' and projectile outer body 60 removed), piston striker 152' has a smaller radius at the tip and a taper to the piston upper end 94. Also, in FIG. 20 the cup for primer 150 is wider and has a larger shelf in projectile upper inner sleeve 80 supporting it. Upon explosion of propellant 101, the combustion gases forces piston 90' downward so that piston lower end 92' moves through and out of the opening 55 in casing 50' and applies force against the launcher barrel breech face 164 (instead of against the casing base or transfer button) to propel the projectile forward. The launcher's extractor system portion 166 engages casing extractor groove 58 to hold casing 50' in place as the projectile is fired. As before, the joint between extension 64 of projectile body 60 and extension 54 of casing 50' controls the release of the projectile from the casing at optimal internal pressures. Although casing 50' in the embodiment of FIG. 19 has the opening 55 through which piston 90' moves, still a significant amount of solid combustion byproducts from the ignition of the propellant are collected in the casing.

Figure 9:
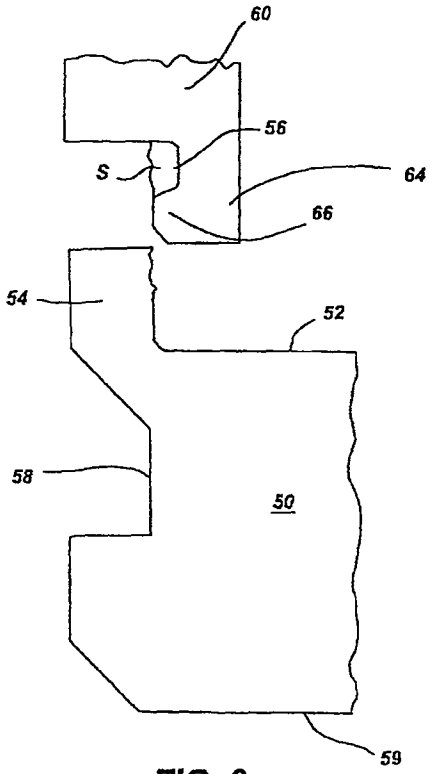
FIG. 9 is an enlarged cross-sectional view of the casing and body configuration of the projectile after firing of the projectile within the launching system.
Figure 21:
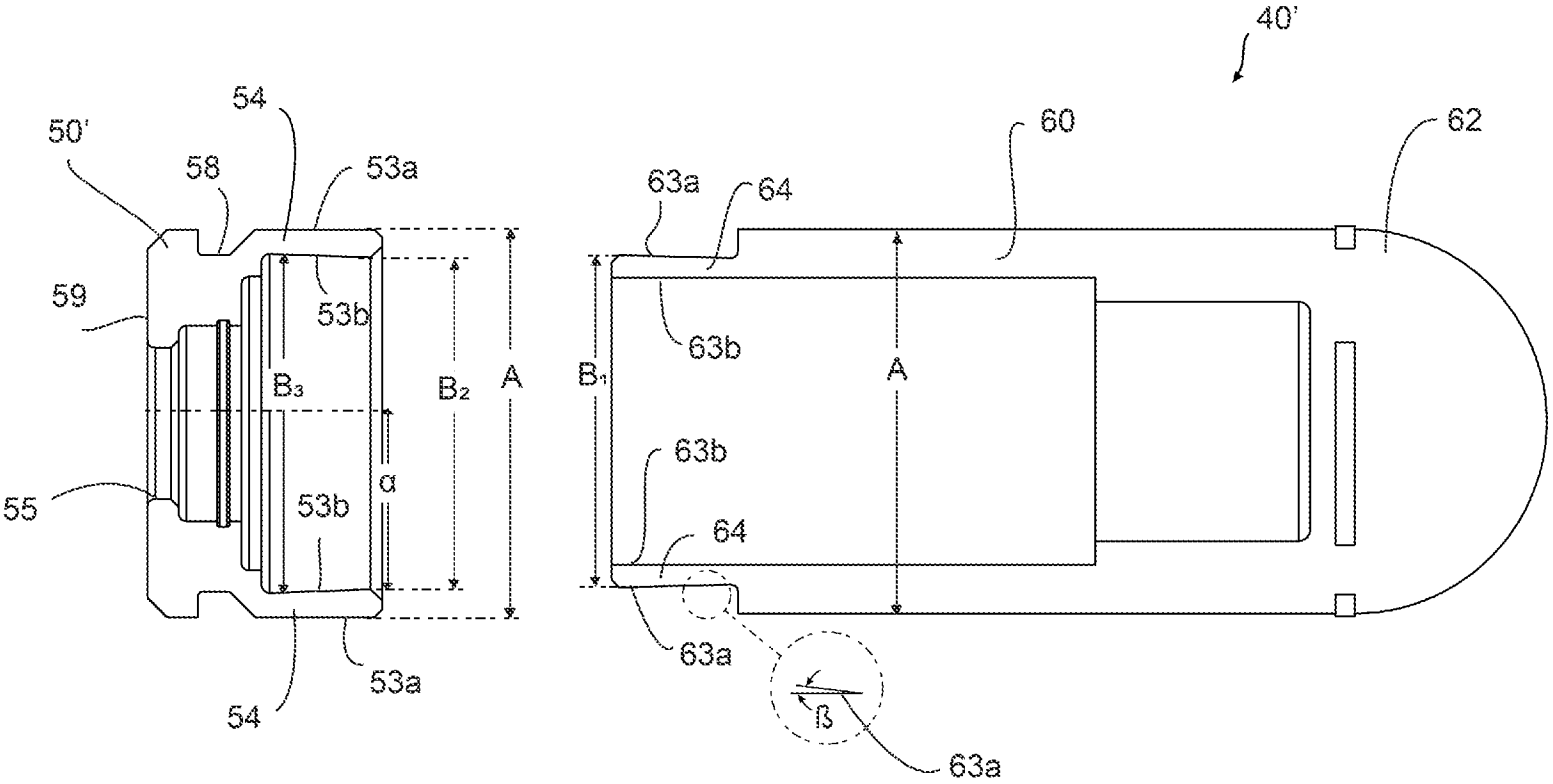
FIG. 21 is an exploded cross-sectional view of an alternate embodiment of the casing and projectile body extensions which form the connecting joint of the projectile of the present invention.

Instead of the stepped frangible shear flange between projectile body extension 64 and casing extension 54 as shown in FIGS. 2, 8 and 9, the piston/rocket projectile 40, 40' of the present invention may utilize a separable joint between the two, such as a conical tapered joint. As shown in FIG. 21, casing 50' has casing upper extension 54 having outer and inner surfaces 53*a*, 53*b*, respectively, which mates with projectile lower extension 64 extending from the base of the projectile body 60 and having outer and inner surfaces 63*a*, 63*b*, respectively. The projectile outer body 60 and casing upper extension outer surface 53*a* have the same diameter A. The inner surface 53*b* of casing upper extension 54 has a diameter less than A, and is not parallel to the outer surface 53*a*, such that diameter B2 at the casing upper extension distal end is less than the diameter B3 of the casing upper extension closer to base 59. This produces an angle α, for example 2°, between the casing 50' longitudinal centerline and upper extension inner surface 53*b*. When the casing upper extension 54 and/or projectile body lower extension 64 are made of a polymer or other material with suitable flexibility, the diameter B1 of the distal end of projectile body lower extension 64 may be slightly greater than diameter B2 at the distal end of casing upper extension 54, so that the extensions 54 and/or 64 flex and change in diameter sufficiently with moderate force as the male projectile body lower extension 64 is inserted into the female casing upper extension 54 to make the joint. The diameter of the projectile body lower extension 64 closer to nose 62 is less than diameter B1, so that the outer surface 63*a* of the projectile body lower extension may have the same or different taper angle β with the projectile longitudinal centerline than angle α of the casing upper extension inner surface 53*b*. This results in an interference fit in cross-sectional view between two frustum-shaped extensions 54, 64, using a reverse or dovetail-type conical joint, that requires a predetermined force threshold to achieve separation, which may be set by the extension angles α, β, the dimensions of the extensions, and the materials used, similar to the manner in which the predetermined force is set to shear the frangible joint described above. A slightly less taper angle β of the projectile body lower extension outer surface 63*a* is believed to result in a more self-tightening joint to better control the overall length of the projectile and provide a better seal against intrusion of contaminants such as water, moisture and oils.

The present invention advantageously reduces and/or significantly eliminates fouling residue on a bolt face electrode inside the barrel chamber. The present invention provides the advantage of a method and apparatus that may be used with an electrically or mechanically energized two stage piston/rocket projectile that captures the majority of the ignition debris and further may be readily evacuated with each round, thereby leaving the chamber with little to no propellant residue. This method and apparatus increases the duty cycle and fired projectile round count before operational field cleaning is needed. In addition, due to the larger diameter of shearing between the base cap and projectile joint, the present invention offers a more accurate release of the projectile within the launching system.

While the present invention has been particularly described, in conjunction with one or more specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A projectile for use with a launcher system having a barrel comprising:

a projectile body having a combustion chamber for propellant, a piston moveable in one direction to ignite the propellant in the combustion chamber and in an opposite direction to protrude out of a base of the projectile as a result of ignition of propellant in the combustion chamber, and vents for expulsion of combustion products from the ignition of propellant out of the projectile base after initial movement of the piston;

a casing secured to the base of the projectile body enclosing the piston and vents prior to the ignition of propellant; and a separable joint between the casing and the base of the projectile body, wherein, upon ignition of propellant in the combustion chamber by movement of the piston in the one direction, the piston is forced in the opposite direction and causes the separable joint to separate, leaving the casing in the barrel such that after the piston completes exertion of propulsion force against the casing, combustion products of the ignition of propellant are expelled through the vents out of a lower end of the projectile and solid combustion byproducts from the ignition of the propellant are collected in the casing.

2. The projectile of claim 1 wherein the separable joint comprises a flange in one of the casing or projectile base secured in a groove in the other of the casing or projectile base, the flange being shearable upon a predetermined force to separate the casing from the projectile body upon ignition of propellant in the combustion chamber and extension of the piston out of the projectile base.

3. The projectile of claim 1 wherein the separable joint comprises a reverse or conical joint flange between the casing and projectile base, the flange being separable upon a predetermined force to separate the casing from the projectile body upon ignition of propellant in the combustion chamber and extension of the piston out of the projectile base.

4. The projectile of claim 1 wherein the propellant in the combustion chamber is ignited by a mechanically-initiated primer.

5. A method of launching a projectile from a launcher system having a barrel and a breech comprising:

providing a projectile body having a combustion chamber for propellant, a piston moveable in one direction to ignite the propellant in the combustion chamber and in an opposite direction to protrude out of a base of the projectile as a result of ignition of propellant in the combustion chamber, and vents for expulsion of combustion products from the ignition of propellant out of the projectile base after initial movement of the piston;

providing a casing secured to the base of the projectile body by a separable joint between the casing and the projectile body base, the casing enclosing the piston and vents prior to the ignition of propellant;

moving the piston in the one direction to ignite propellant in the combustion chamber, causing the piston to be forced in the opposite direction and causing the joint to separate, thereby leaving the casing in the barrel such that after the piston completes exertion of propulsion force against the casing, combustion products of the ignition of propellant are expelled through the vents out of a lower end of the projectile and solid combustion products from the ignition of propellant are collected in the casing.

6. The method of claim 5 wherein the separable joint in the casing is separated upon a predetermined force by the piston to separate the casing from the projectile body upon ignition of propellant in the combustion chamber and extension of the piston out of the projectile base.

7. The method of claim 5 wherein the separable joint comprises a flange in one of the casing or projectile base secured in a groove in the other of the casing or projectile base, and wherein the flange is sheared upon a predetermined force by the piston to separate the casing from the projectile body upon ignition of propellant in the combustion chamber and extension of the piston out of the projectile base.

8. The method of claim 5 wherein the separable joint comprises a reverse or conical joint flange between the casing and projectile base, the flange being separable upon a predetermined force to separate the casing from the projectile body upon ignition of propellant in the combustion chamber and extension of the piston out of the projectile base.

9. The method of claim 5 wherein the propellant in the combustion chamber is ignited by a mechanically-initiated primer.

10. A projectile for use with a launcher system having a barrel comprising:

a projectile body having a combustion chamber for propellant, a piston moveable to protrude out of a base of the projectile as a result of ignition of propellant in the combustion chamber, and vents for expulsion of combustion products from the ignition of propellant out of the projectile base after initial movement of the piston, the vents being formed in part by walls of an inner surface of the projectile body and in part by an outer surface of the piston; and a casing secured to the base of the projectile body by a joint between the casing and the base of the projectile body, the casing enclosing the piston and vents prior to the ignition of propellant, wherein, upon ignition of propellant in the combustion chamber the piston exerts a propulsive force against the casing and, the piston moves such that the vents are exposed before the piston reaches a limit of travel within the projectile body, whereupon combustion products of the ignition of propellant are expelled through the vents out of the lower end of the projectile.

11. The projectile of claim 10 wherein the vents are non-circular in cross-section and are extruded into an inner surface of the projectile body.

12. The projectile of claim 10 wherein the propellant in the combustion chamber is ignited electrically.

13. The projectile of claim 12 further including a gel-type propellant in the combustion chamber and an electrode extending into the gel-type propellant in the combustion chamber for ignition of propellant.

14. The projectile of claim 10 wherein the propellant in the combustion chamber is ignited by a mechanically-initiated primer.

15. A projectile for use with a launcher system having a barrel comprising:

a projectile body formed of an electrically non-conductive material having a combustion chamber for propellant, the combustion chamber having a gel-type propellant therein and an electrode extending through the projectile body and into the combustion chamber for electrically igniting the gel-type propellant, a piston moveable to extend out a base of the projectile as a result of ignition of said gel-type propellant in the combustion chamber, and vents for expulsion of combustion products from the ignition of the gel-type propellant out of the projectile base after initial movement of the piston;

a non-electrically conductive layer between the gel-type propellant and the end of the chamber opposite the piston, the non-electrically conductive layer covering at least a portion of a width of the combustion chamber, said non-electrically conductive layer having an opening therein through which extends the electrode; and an electrically conductive layer covering at least a portion of the width of the combustion chamber, said electrically conductive layer disposed between the non-electrically conductive layer and the gel-type propellant in electrical contact with an end of the electrode, wherein, upon ignition of the gel-type propellant by the electrode and electrically conductive layer in the combustion chamber, the piston is forced outward from the lower end of the projectile and subsequently combustion products of the ignition of the gel-type propellant are expelled through the vents out of the lower end of the projectile.

16. The projectile of claim 15 wherein the non-electrically conductive layer covers the entire width of the combustion chamber.

17. The projectile of claim 16 wherein the non-electrically conductive layer includes projections extending along side walls of the combustion chamber.

18. The projectile of claim 15 wherein the electrically conductive layer covers the entire width of the combustion chamber.

19. The projectile of claim 18 wherein the electrically conductive layer has a projection extending therefrom in contact with the end of the electrode.

* * * * *